United States Patent [19]

Gordon et al.

[11] Patent Number: 4,869,646

[45] Date of Patent: Sep. 26, 1989

[54] CONTINUOUS PERISTALTIC PUMP

[75] Inventors: Mark G. Gordon, Tustin; Bernadino Rubalcaba, Jr., Laguna Beach; Jerry L. Jackman, Tustin, all of Calif.

[73] Assignee: American Hospital Supply Corp., Evanston, Ill.

[21] Appl. No.: 661,032

[22] Filed: Oct. 15, 1984

[51] Int. Cl.[4] ..... F04B 49/00

[52] U.S. Cl. ..... 417/18; 417/63; 417/414

[58] Field of Search ..... 604/65, 67; 128/DIG. 12; 417/18, 22, 63, 474

[56] References Cited

U.S. PATENT DOCUMENTS 4,604,034 8/1986 Wheeldon ..... 417/18

*Primary Examiner*—William L. Freeh

*Attorney, Agent, or Firm*—Weissenberger & Peterson

[57] ABSTRACT

Substantially continuous fluid delivery in a variable-speed peristaltic pump is achieved by operating the pump at maximum speed through most of the deadband regardless of the delivery rate. Safety means are disclosed to monitor the correct operation of the speed control.

4 Claims, 3 Drawing Sheets

FIG. 1
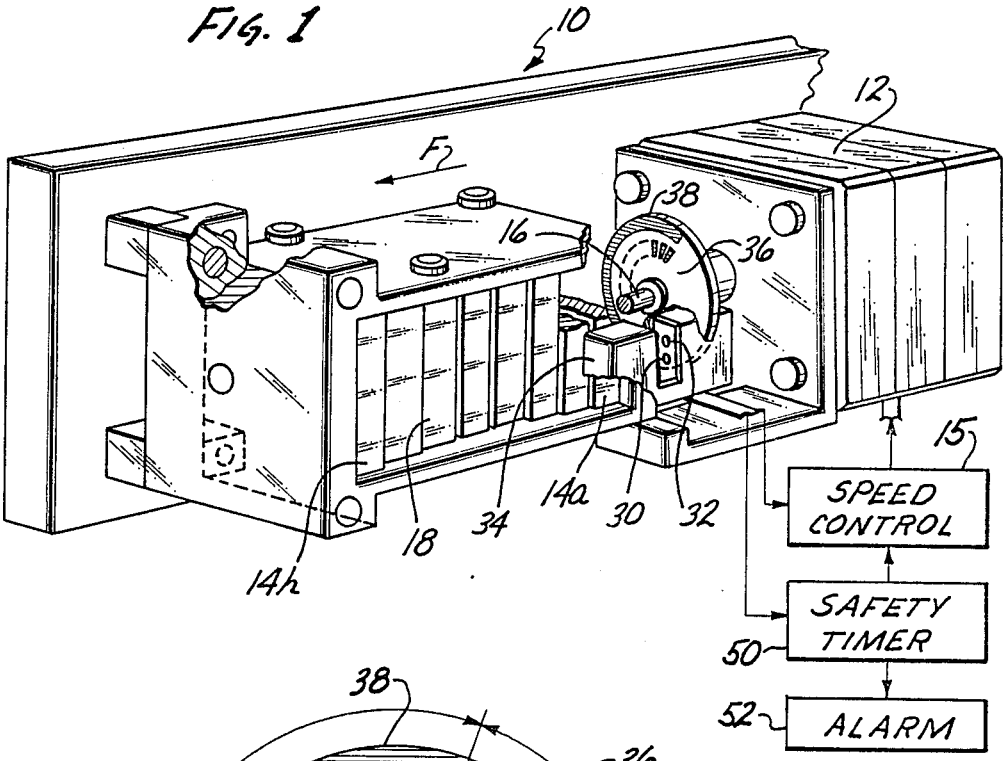
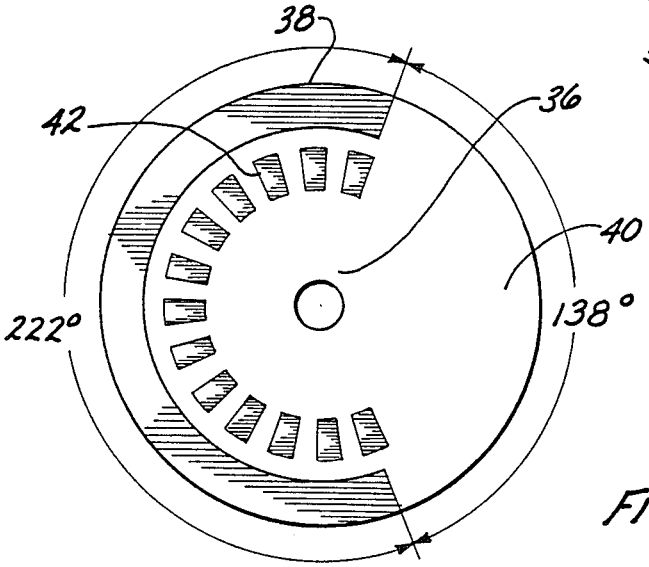
FIG. 5

CONTINUOUS PERISTALTIC PUMP

CONTINUOUS DELIVERY PERISTALTIC PUMP

This invention relates to peristaltic pumps, and particularly to a pump of that type which is capable of providing essentially continuous delivery of medication over an extremely wide range of delivery rates.

BACKGROUND OF THE INVENTION

Peristaltic pumps are widely used in medical applications for the intravenous administration of various fluids. A sophisticated type of medical peristaltic pump must be able to accurately deliver fluids at a rate varying from at least 1 ml/hr to about 1,000 ml/hr. It is inherent in the nature of peristaltic pumps that because of the stroke volume in the tube being refilled, the pump must have a deadband during which no delivery of fluid takes place. Specifically, in a typical peristaltic pump, approximately 150° out of each 360° cycle of pump operation intervenes between the end of one measured fluid increment and the beginning of the next. If the pump is running at high speed, this deadband causes little or no problems, as the interval between fluid increments is only a few tenths of a second. If, however, the pump is running at extremely low rates, it is possible for the interval between fluid increments to become as long as several minutes. During this time, the patient receives no medication at all, and medically unacceptable conditions result.

SUMMARY OF THE INVENTION

The present invention overcomes the problem of the prior art by, in effect, operating the pump at its maximum speed during the deadband portion of the cycle regardless of the delivery rate to which it is set. In this manner, the deadband is always a mere fraction of a second, and the delivery of fluid is essentially continuous regardless of the delivery rate.

In the preferred embodiment, the pump is driven by a step motor whose stepping rate is electronically timed to provide the required flow rate. However, during the deadband portion of the cycle (typically 138° of the cycle), the stepping rate returns to the maximum design rate of the drive.

It is therefore the object of the invention to provide essentially continuous flow in a peristaltic pump, regardless of the flow rate, by operating the drive motor at maximum speed during the interval between fluid increments.

BRIEF DESCRIPTION OF THE DRAWINGS

FIG. 1 is a perspective view, partially cut away, of the pressure fingers and drive control of the pump of this invention.

FIGS. 4*a* and 5*b* are plan views of two embodiments of the optical control disk for the pump motor.

DESCRIPTION OF THE PREFERRED EMBODIMENT

Figure 2:
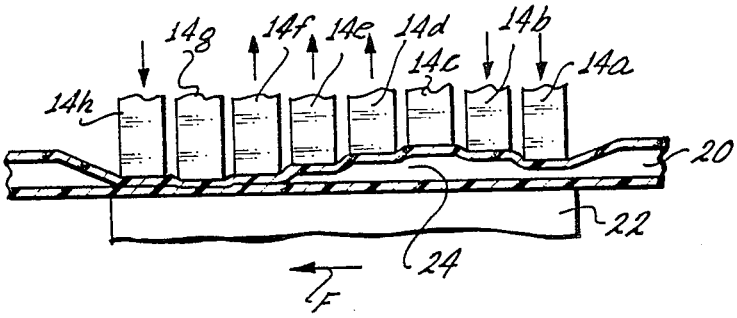
FIG. 2 is a schematic view of the pressure fingers at the beginning of the deadband.

FIG. 1 shows a peristaltic pump 10 (omitting, for purposes of drawing clarity, the pressure plate and fluid-carrying flexible conduit). The pump 10 consists of a motor 12 controlled by a conventional, speed control 15, which drives a set of fingers 14*a* through 14*h*. The fingers 14*a* through 14*g* are individually movable forward and backward by eccentric cams (not shown) in a well-known manner. The cams are driven by the shaft 16 of motor 12. The fingers 14*a* through 14*h* go through one complete in-and-out cycle for each 360° revolution of shaft 16.

The cams which drive the fingers 14*a* through 14*b* are so arranged that the motion of each finger 14 is displaced by 45° of the rotation of shaft 16 from the movement of the adjacent finger 16. Consequently, as the shaft 16 turns, a ripple effect occurs in the fingers 14 in which the wave shape 18 produced by the fingers 14 appears to move in the direction of the arrow F.

Turning now to FIG. 2, it will be noted that in operation, the fingers 14 squeeze a resilient fluid-carrying tube 20 against the pressure plate 22. In FIG. 2, it will be noted that the tube 20 is occluded by fingers 14*h* and 14*f*, and particularly so by finger 14*g*. At the same time, a fluid increment 24 is drawn into the cavity in tube 20 formed by the retraction of fingers 14*a* through 14*e*.

Figure 3:
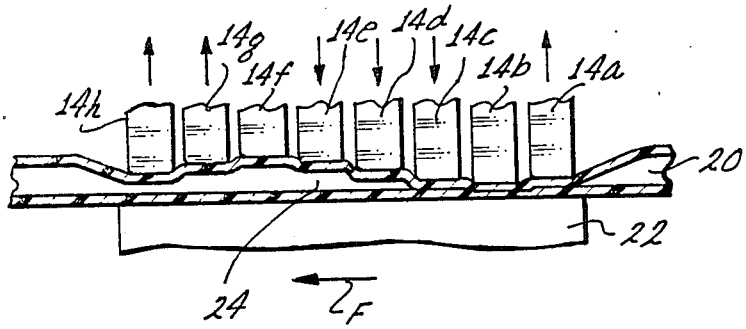
FIG. 3 is a figure similar to FIG. 2 but showing the finger positions at the end of the deadband.

FIG. 3 shows the pump approximately 135° later in its cycle when the last of the occluding fingers 14*h* has withdrawn sufficiently to allow the fluid increment 24 to flow to the downstream side of conduit 20 while the upstream end of conduit 20 is separated from the fluid increment 24 by fingers 14*a*, 14*b* and 14*c*.

Figure 4:
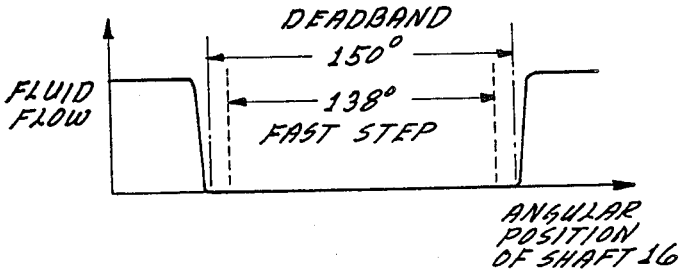
FIG. 4 is a graph showing the angular relations of the events during the deadband.

Referring now to FIG. 4, which shows nominal fluid flow as a function of the angular position of shaft 16, it will be seen that, considering the physical parameters of the tube 20 and the fingers 14, there is in each revolution of shaft 16 an interval or deadband of about 150° during which no part of any fluid increment 24 flows into the downstream side of conduit 20. If the fluid increment 24 conveyed during each 360° revolution of shaft 16 is 0.122 ml, and the desired delivery rate is 1 ml/hr, the shaft 16 must make 8.2 revolutions per hour. At a constant rotational speed, it would therefore take slightly more than three minutes to traverse the deadband on each revolution. This is substantially longer than the two-minute maximum time for which a patient on continuous medication should be left unmedicated.

For this reason, and also because any interruption in continuous medication, however short, is undesirable, the present invention provides for the virtual elimination of the deadband by stepping through it at the maximum design rate of motor 12. If the stepping motor 12 is so constructed as to turn the shaft 161.8° per step, the 150° deadband corresponds to approximately 83 steps. Because of the possibility that the center of the deadband may not exactly coincide with the center of the fast-stepping portion of the revolution of shaft 16, and because a fast step outside the deadband may produce an undesirable medication surge at slow delivery rates, the fast-stepping portion of the revolution is held to about 138° (i.e. 77 steps), as shown in FIG. 4.

The maximum stepping rate of a typical embodiment of motor 12 is 2.0 ms/step, corresponding to a delivery rate of about 1,100 ml/hr. The deadband duration at that speed is less than 170. ms—a negligibly small amount of time.

In accordance with the invention, an approximately 138° segment of each revolution of shaft 16 lying within the 150° deadband is always traversed at maximum speed. This 138° segments corresponds to 77 out of the 200 motor steps which constitute a full 360° revolution of shaft 16 in the preferred embodiment. Consequently, at the lowest delivery rate of 1 ml/hr, 123 steps of each revolution are performed in a little over 7.3 minutes, while the remaining 77 steps are performed in less than two-tenths of a second.

Because the deadband is about 6 steps wider than the fast-stepping portion of the revolution, there is an actual stoppage of medication at the slowest delivery rate of a little over twenty seconds—well below the two-minute limit mentioned above.

The control of the motor 12 in accordance with the foregoing principles is accomplished by a pair of photocells 30, 32 (FIG. 1) which are separated from a light source 34 by a patterned transparent disc 36 mounted on the shaft 16. FIG. 5*a* shows the detail of the pattern on disc 36. Whenever any portion of the opaque area 38 is between the light source 34 and either photocell 30 or 32, the motor 12 steps at whatever rate is manually set on the speed control 15 to correspond to the desired fluid delivery rate. When the transparent area 40 is in front of both photocells 30 and 32, the light impinging on the photocells causes them to switch the motor 12, by conventional means within the speed control 15, to its maximum stepping rate.

It will be noted that if the disc 36 turns in the direction of the arrow R, and if the opaque area of the disc 36 is designated as logic "1", the photocells 30, 32 behind the disc 36 will see, respectively, a condition sequence of 00-10-11-01. This condition sequence is transmitted (FIG. 1) to the safety circuit 50. If the motor 12 turns in the wrong direction for any reason, the safety circuit 50 senses the reversal of the above condition sequence, stops the pump 10, and actuates an alarm 52.

As indicated in FIG. 1, the stepping commands which drive motor 12 are also applied to the safety circuit 50. If the three portions of the opaque area 38 are each forty-one steps long, and the clear area 40 is seventy-seven steps long, the safety circuit shuts off the pump 10 and triggers the alarm 52 if a transition does not occur in the above-described condition sequence within seventy-seven steps (plus or minus an appropriate margin for counting errors) when the condition is 00, or within forty-one steps (plus or minus the error margin) when the condition is 10, 11, or 01.

If the number of steps allowed before a transition is substantially exceeded, a stalling of the motor 12 is indicated. On the other hand, if a transition takes place too early, or several transitions occur in rapid succession, this is probably due to a jitter of the motor 12 at a transition point. Both of these circumstances call for, and do produce, a shutdown and alarm.

FIG. 5*b* illustrates an alternative embodiment of the disc 36 which is useful in microinfusion pumps, i.e. pumps of the type described which are capable of delivering as little as 0.1 ml/hr with the same tubing and pumping mechanism. In that type of pump, the forty-one step interval between the segments of the opaque area 38 (during which the motor 12 steps at slow speed) would correspond to nearly 25 minutes, which is many times more than the maximum allowable medication-free time.

Consequently, the embodiment of FIG. 5*b* uses a ring of opaque wedges 42 which are five steps wide and are spaced five steps apart. In that case, the safety circuit is arranged to provide a shutdown and alarm if photocell 32 fails to see a transition about every five steps. At the slowest delivery speed, a stall of motor 12 will thus provide an alarm within at most three minutes—a substantial time but not a critical one at the slowest microinfusion speed.

In the embodiment of FIG. 5*b*, the stepping speed is controlled solely by photocell 30, which alone sees the opaque sector 38 and the clear sector 40. However, recognition of the direction of rotation of motor 12 is still provided by the fact that a transition occurs simultaneously on both photocells at the beginning of the 123-step opaque sector 38, while the transition from the opaque sector 38 to the clear sector 40 does not occur simultaneously with a transition of the wedges 42.

We claim:

1. A peristaltic pump, comprising:

(a) cyclic pumping means for peristaltically pumping fluid in increments separated by deadbands;

(b) stepped motor means for driving said pumping means;

(c) control means for selectively driving said motor means at first and second speeds;

(d) speed changing means connected to said control means for driving said motor means at said first speed outside said deadband, and at said second speed inside said deadband;

(e) said speed changing means including:

(i) a partially opaqued transparent disc rotated by said motor means in synchronism with said pumping means;

(ii) a light source; and (iii) photoelectric means connected to said control means and cooperating with said disc and light source for generating a first speed signal in the presence of an opaque portion of said disc, and a second speed signal in the presence of a transparent portion of said disc; and (f) safety means for sensing malfunctions of said motor means and said speed changing means, said safety means including:

(i) a counter arranged to count stepping commands to said stepped motor means;

(ii) pattern means on said disc for producing alternating opaque and transparent areas;

(iii) photoelectric means connected to said timer and cooperating with said disc and said light source for generating a signal adapted to reset said counter in the presence of transitions between said opaque and transparent areas; and (iv) alarm means connected to said counter for providing an alarm indication when said counter is not reset within a predetermined count.

2. The pump of claim 1, in which said pattern is such as to trigger an alarm indication when the speed of said motor means is less than a predetermined minimum.

3. The pump of claim 2, in which said pattern is further such as to trigger an alarm indication when said transparent portion is not traversed within a predetermined maximum number of step commands.

4. The pump of claim 2, in which said pattern is further such as to trigger an alarm indication when said transparent portion is not traversed within a predetermined maximum or minimum number of stepping commands.

* * * * *